US006596952B1

(12) United States Patent
Degrazia et al.

(10) Patent No.: US 6,596,952 B1
(45) Date of Patent: Jul. 22, 2003

(54) LOCKING MECHANISM FOR A ROTARY HANDLE OPERATOR

(75) Inventors: Dean Basil Degrazia, Pittsburgh, PA (US); Andrew James Male, Export, PA (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 10/141,163

(22) Filed: May 8, 2002

(51) Int. Cl.[7] ..... H01H 3/20
(52) U.S. Cl. ..... 200/330; 200/43.16
(58) Field of Search ..... 200/43.16, 43.11, 200/43.14–14.16, 43.21, 330, 343, 345, 250, 409, 325

(56) References Cited

U.S. PATENT DOCUMENTS 3,800,114 A * 3/1974 Strobel ..... 200/330
5,219,070 A 6/1993 Grunert et al.
5,288,958 A * 2/1994 Grunert et al. ..... 200/331
5,700,985 A 12/1997 Fischer et al.
5,902,973 A * 5/1999 Ramey et al. ..... 200/50.01

* cited by examiner

*Primary Examiner*—Elvin Enad
*Assistant Examiner*—Lisa N Klaus
(74) *Attorney, Agent, or Firm*—Martin J. Moran

(57) ABSTRACT

A rotary handle operator for a circuit breaker includes a lock plate having a live spring, formed as one piece with the lock plate, for biasing the lock plate in its unlocked position. With the lock plate in this unlocked position, rotation of the rotary handle operator's handle will actuate movement of a sliding member within the rotary handle operator, thereby moving the operating lever of the circuit breaker from its on position to its off position, and vice versa. When the rotating handle is in its off position, the lock plate may be pivoted against the bias of the springs so that the lock plate fits within a slot in the housing of the rotary handle operator, thereby resisting movement of the handle. In this position, an aperture dimensioned and configured to receive the shackle of a lock protrudes upward from the handle, permitting insertion of a lock to secure the lock plate in this locked position.

7 Claims, 6 Drawing Sheets

LOCKING MECHANISM FOR A ROTARY HANDLE OPERATOR

BACKGROUND OF THE INVENTION

1. Field of the Invention

The present invention relates to rotary handle operators for circuit breakers. More specifically, the present invention provides an improved lockout mechanism for a rotary handle operator.

2. Description of the Related Art

Most circuit breakers include an operating lever which moves linearly between an on position and an off position. The handle is connected to the movable contacts of the circuit breaker through an over-center toggle device which separates the contacts, simultaneously moving the operating lever, in response to overcurrent conditions.

For certain circuit breaker applications, it is desirable to provide an interface between the operating lever and the human operator. Such an interface will frequently take the form of a rotary handle operator, wherein a rotary handle is utilized to actuate a linearly moving member, which in turn actuates the circuit breaker's operating handle.

When servicing the equipment protected by the circuit breaker, it is desirable to lock out electrical power to the equipment, preventing any possibility of injury to those servicing the equipment. Therefore, it is desirable to be able to lock the handle of the rotary handle operator, and therefore the operating lever of the circuit breaker, in the open position.

An example of a lockable rotary handle operator is described in U.S. Pat. No. 5,219,070, issued to K. A. Grunnert et al. on Jun. 15, 1993, and assigned to Westinghouse Electric Corp. The rotary handle operator includes a rotatable handle engaging a pinion gear, which in turn engages a slidably mounted rack. The rack engages the circuit breaker handle. Rotating the handle will therefore rotate the pinion gear, causing the rack to move, moving the circuit breaker's operating lever from one position to the other. When the handle is in the off position, inserting the shackle of a padlock through an aperture in the handle will push a spring-biased pin into an aperture in the rotary handle operator's housing, thereby resisting rotation of the handle from the off position.

Another presently available rotary handle operator includes a pivoting lock-off plate moving between an unlocked position wherein rotation of the rotary handle operator's handle is permitted, and a locked position wherein one end of the lock-off plate fits within a slot in the rotary handle operator's housing, thereby resisting movement of the handle. The lock-off plate is biased by a coil spring into the unlocked position. An aperture in the opposite end of the lock-off plates protrudes upward from the handle in the locked position, permitting insertion of the shackle of a padlock into the aperture, thereby securing the lock-off plate in the locked position.

It is desirable to reduce the number of components within a rotary handle operator's locking mechanism, thereby reducing both the cost of these components and the number of assembly steps in building the rotary handle operator.

SUMMARY OF THE INVENTION

The present invention provides an improved locking mechanism for a rotary handle operator for a circuit breaker.

The improved locking mechanism includes a lock plate pivotally secured within the rotary handle operator's handle.

The lock plate includes a live spring, molded as one piece with the lock plate, for biasing the lock plate into its unlocked position. The lock plate includes one end dimensioned and configured to abut an abutment depending from the housing of the rotary handle operator when the handle is in the off position, and the lock plate is in the locked position, and another end defining an aperture dimensioned and configured to permit passage of a padlock's shackle when the lock plate is in the locked position.

The rotary handle operator includes a housing on which a pivotally mounted handle is secured. The handle is secured to a gear so that rotation of the handle will simultaneously rotate the gear. Rotation of this gear will actuate movement of a sliding member, possibly through the interaction of a second gear between the first gear and the sliding member, so that the sliding member may thereby be reciprocated along a linear path. The sliding member engages the operating lever of the circuit breaker, so that movement of the sliding member will control movement of the circuit breaker's operating handle. Rotation of the rotary handle operator's handle from the off position to the on position will therefore cause the sliding member to move the circuit breaker's operating lever from the off position to the on position, while rotation of the handle from the on position to the off position will likewise cause the sliding member to move the circuit breaker's operating lever from its on position to its off position.

When the rotary handle is in the off position, the lock plate may be pivoted against the bias of the spring so that the aperture protrudes from the handle. Inserting the shackle of a lock, such as a padlock, through the aperture within the handle secures the lock plate in the locked position, thereby resisting movement of the handle to the on position. Upon removal of the lock's shackle, the lock plate will return to the unlocked position under the bias of the spring, permitting rotation of the handle.

BRIEF DESCRIPTION OF THE DRAWINGS

Like reference numbers denote like elements throughout the drawings.

DETAILED DESCRIPTION

Figure 1:
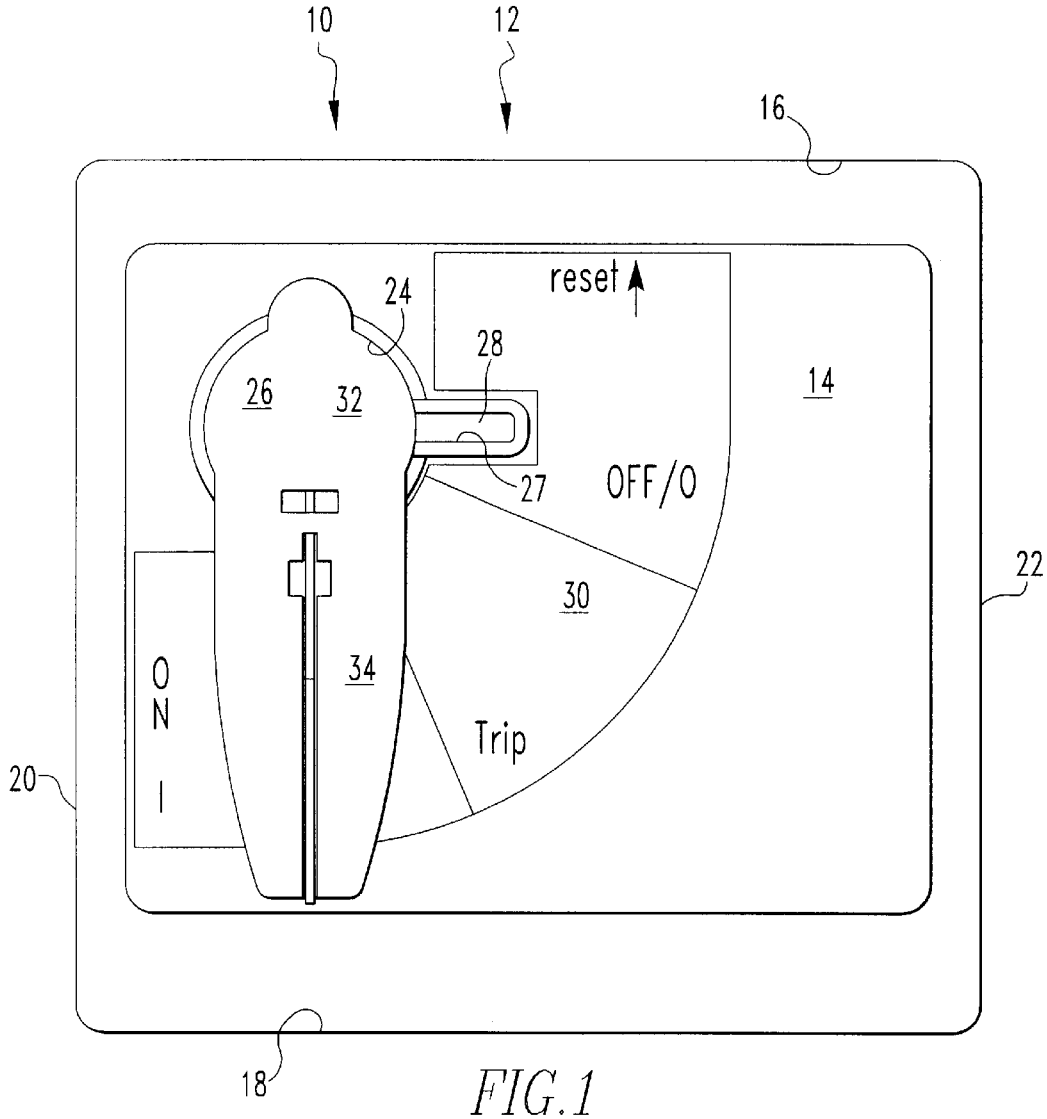
FIG. 1 is a front view of a rotary handle operator according to the present invention, illustrating the handle in the on position.

The present invention provides an improved locking mechanism for a rotary handle operator for circuit breakers.

Referring to FIGS. 1, 3–4, and 6, a rotary handle operator is illustrated. The rotary handle operator 10 includes a housing 12, dimensioned and configured to be secured to the face 92 of a circuit breaker 94. The housing 12 defines a face 14, a top 16, a bottom 18, and a pair of sides 20, 22. The face 14 defines a hole 24 through which the handle 26 passes, and an abutment 27, which in some preferred embodiments is a slot 28, corresponding to the off or open position of the handle 26 (described in detail below). The face 14 may also optionally include indicia 30, denoting the various positions of the handle 26.

Figure 2:
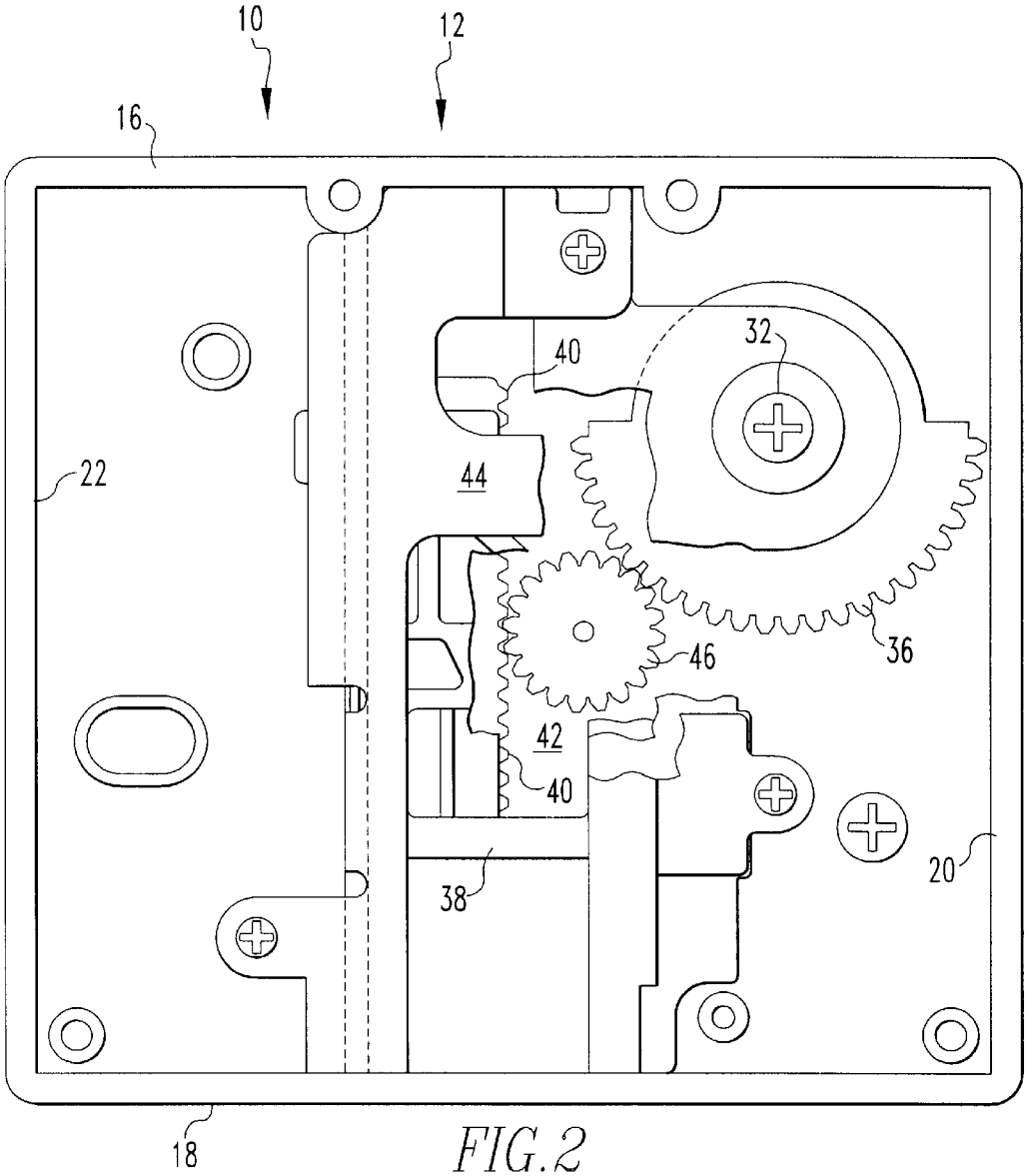
FIG. 2 is a rear view of a rotary handle operator according to the present invention, illustrating the handle in the on position.
Figure 3:
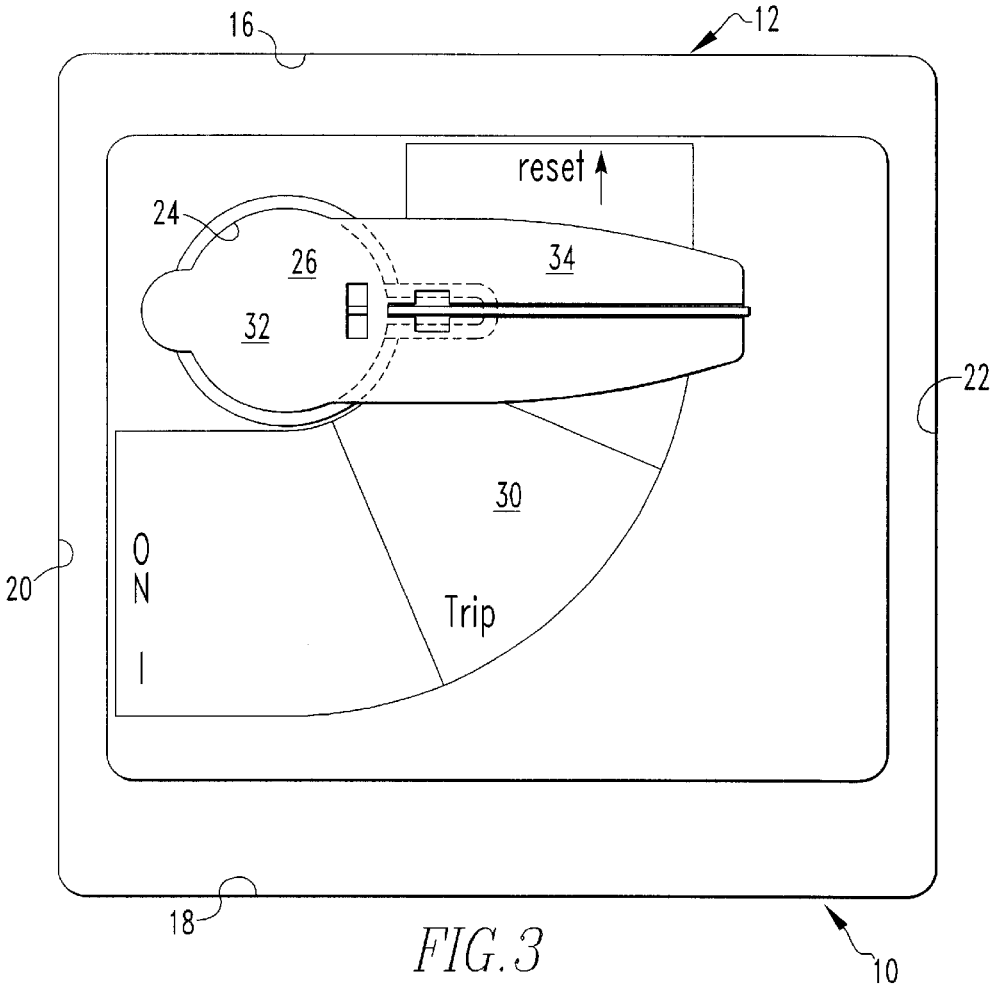
FIG. 3 is a front view of a rotary handle operator according to the present invention, illustrating the handle in the off position, and the lock plate in the unlocked position.
Figure 5:
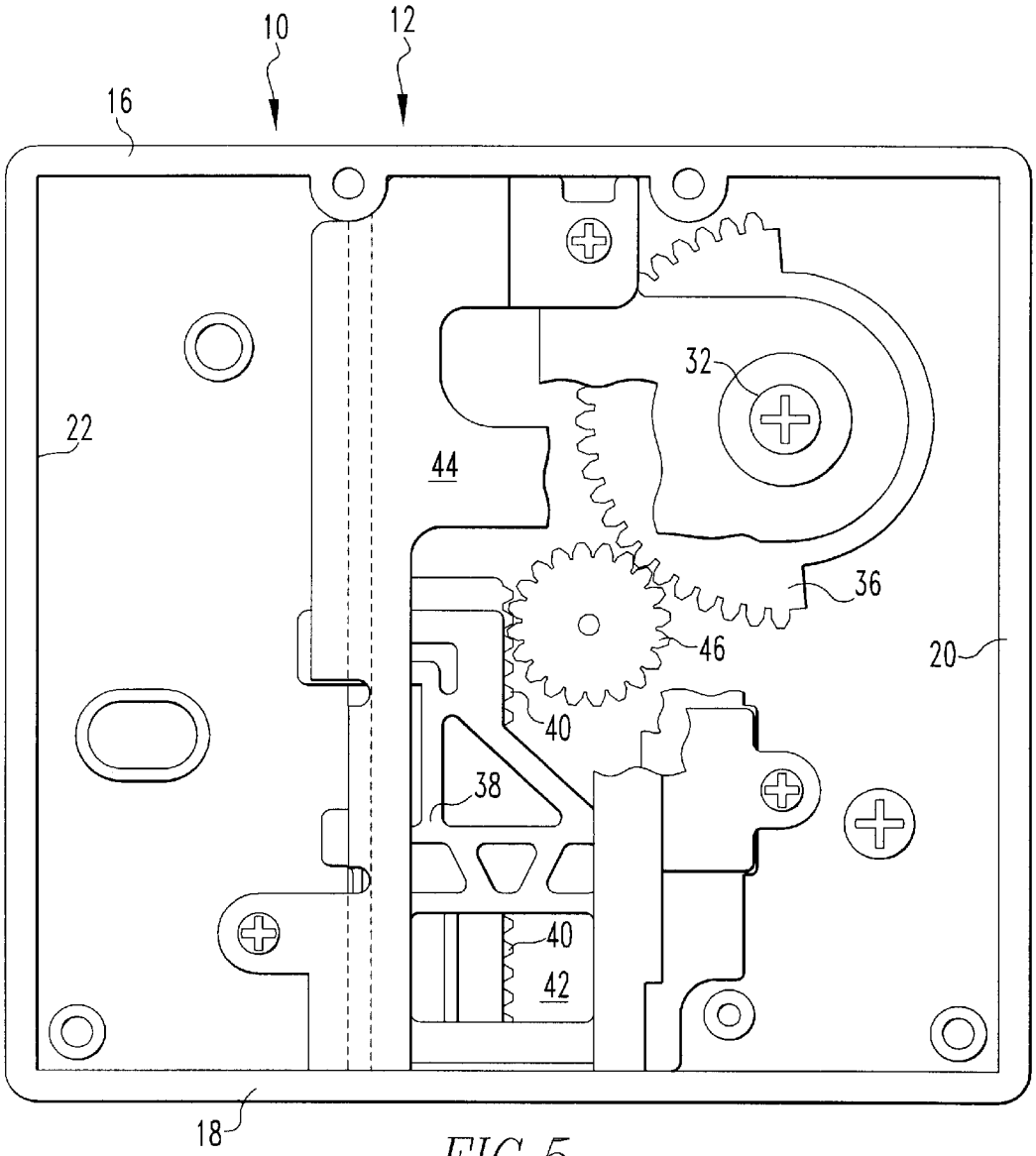
FIG. 5 is a rear view of a rotary handle operator according to the present invention, illustrating the handle in the off position.

The handle 26 includes a fulcrum 32, passing through the hole 24, and a grasping portion 34, extending substantially perpendicular to the fulcrum 32. Referring to FIGS. 2 and 5, the opposite end of the fulcrum 32 is secured to a gear 36.

The handle 26 is operatively connected to a slider 38, so that rotation of the handle 26 through its range of motion (which in the present example is approximately 90 degrees, but which may deviate substantially from this amount without compromising the invention) will move the slider 38 linearly through its corresponding range of motion. The slider 38 includes a plurality of gear teeth 40, and defines an opening 42, dimensioned and configured to receive the operating lever or handle 96 of a circuit breaker. The slider 38 is secured between the housing 12 and a slider bracket 44, with the slider bracket 44 defining a channel within which the slider 38 may move. In the illustrated example of a rotary handle operator, the gear 46 engages both the gear 36 and the gear teeth 40 of the slider 38.

When the handle 26 is rotated to its closed or on position of FIG. 1, the slider 38 will be in its upper position of FIG. 2, corresponding to the closed position of a circuit breaker 94. Rotation of the handle 26 from the on position of FIG. 1 to the off or open position of FIG. 3, the rotation of the gear 36 will rotate the gear 46, causing the slider 38 to move from the upper position of FIG. 2 to the lower position of FIG. 5, corresponding to the off or open position of a circuit breaker 94. The position of the circuit breaker's operating lever 96 is thereby controlled by the position of the handle 26.

When servicing the equipment protected by the circuit breaker 94, it is desirable to lock out electrical power to that equipment. This may be accomplished by securing the handle 26 in its off or open position.

Figure 4:
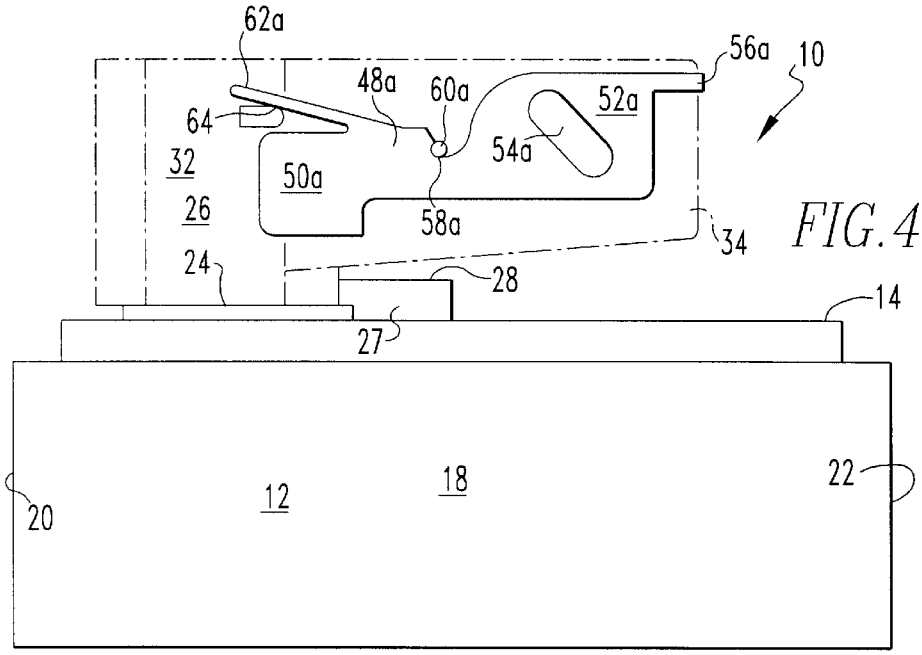
FIG. 4 is a bottom view of a rotary handle operator according to the present invention, illustrating the handle in the off position and the lock plate in the unlocked position.
Figure 6:
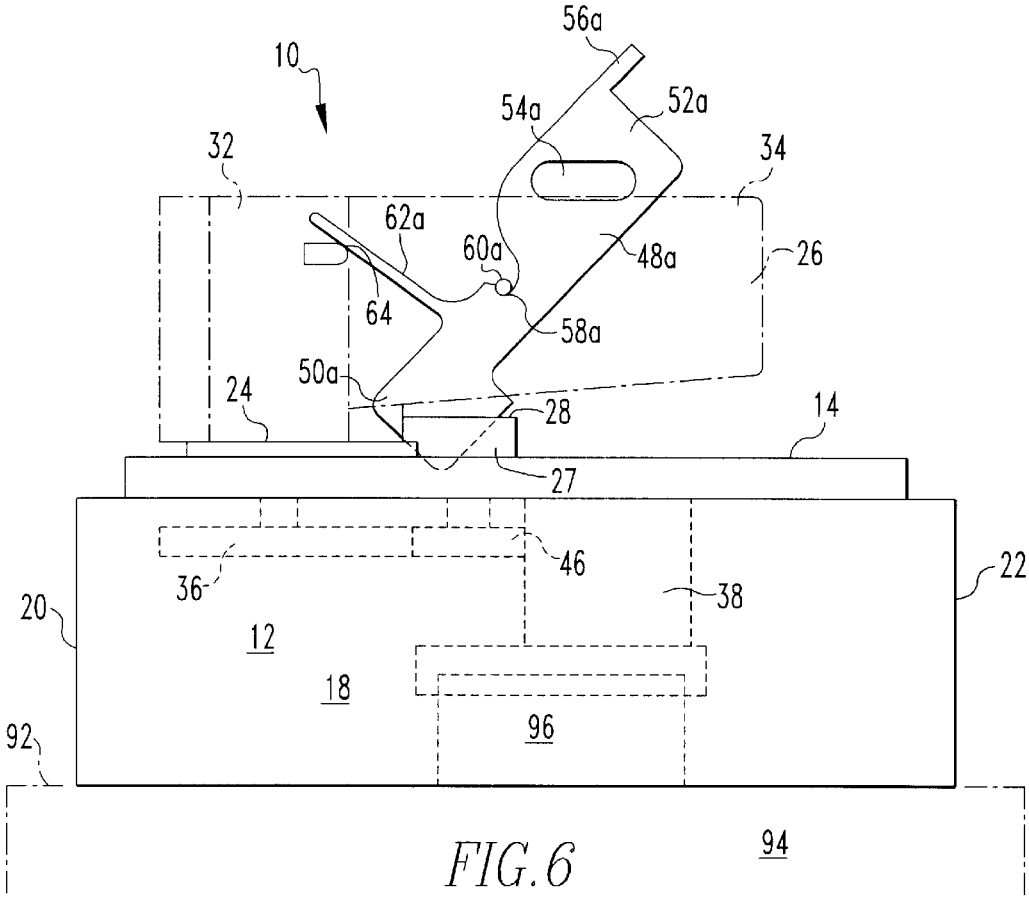
FIG. 6 is a bottom view of a rotary handle operator and associated circuit breaker according to the present invention, illustrating the handle in the off position and the locking plate in the locked position.
Figure 9:
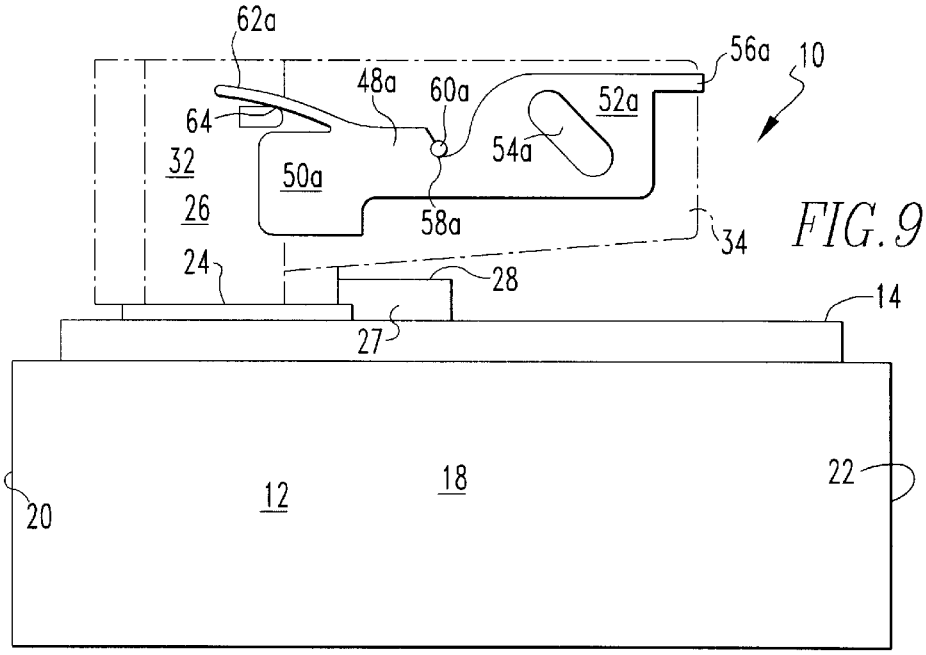
FIG. 9 is a bottom view of another alternative rotary handle operator of the present invention, illustrating the handle in the off position and the lock plate in the unlocked position.

Referring to FIGS. 4 and 6, a lock plate 48*a* of the present invention is illustrated. The lock plate 48*a* includes an abutment engaging end or a slot-engaging end 50*a* and a lock-engaging end 52*a*. The abutment-engaging end 50*a* is dimensioned and configured to abut the abutment 27, possibly by fitting within the slot 28. The lock-engaging end 52*a* includes an aperture 54*a*, dimensioned and configured to receive the shank of a lock, such as a padlock, and a finger tab 56*a*. The lock plate 48*a* includes a central portion defining a channel 58*a*, for receiving a pivot 60*a*. The channel 58*a* may be an open channel or a closed hole, as long as a pivot is capable of passing through it. The lock plate 48*a* also includes a live spring 62*a*, molded as one piece with the lock plate 48*a*. Some preferred embodiments of the spring 62*a* are generally linear, but the spring 62*a* may also be curved and still function according to the invention. In the illustrated example, the spring 62*a* extends from the slot-engaging end 50*a* of the lock plate 48*a*.

The lock plate 48*a* is pivotally secured within the grasping portion 34 of the handle 26, and in many preferred embodiments will be substantially parallel to the grasping portion 34. With the handle 26 in its off position, the lock plate 48*a* may pivot between an unlocked position, illustrated in FIG. 4, permitting rotation of the handle 26, and a locked position illustrated in FIG. 6, wherein the abutment-engaging end 50*a* of the lock plate 48*a* abuts the abutment 27, possibly by being contained within the slot 28, thereby resisting rotation of the handle 26. Also within the locked position of FIG. 6, the aperture 54*a* protrudes from the handle 26, permitting passage of the shank of a lock through the aperture 54*a*, thereby securing the lock plate 48*a* in this locked position. The spring 62*a* is dimensioned and configured to bias the lock plate 48*a* towards the unlocked position of FIG. 4, for example, by bearing against the surface 64 within the handle 26.

A lock plate 48*a* of the present invention (and also the lock plate 48*b*, described below) can be made from any one of a wide variety of semi-rigid, flexible materials. Examples include plastics, polymers, and molded resins. The material selected should be sufficiently rigid so that the interaction between the slot-engaging end 50*a* and the slot abutment 27 resists movement of the handle 26, and sufficiently flexible so that the spring 62*a* will permit rotation of the lock plate 48*a* towards its locked position.

Figure 7:
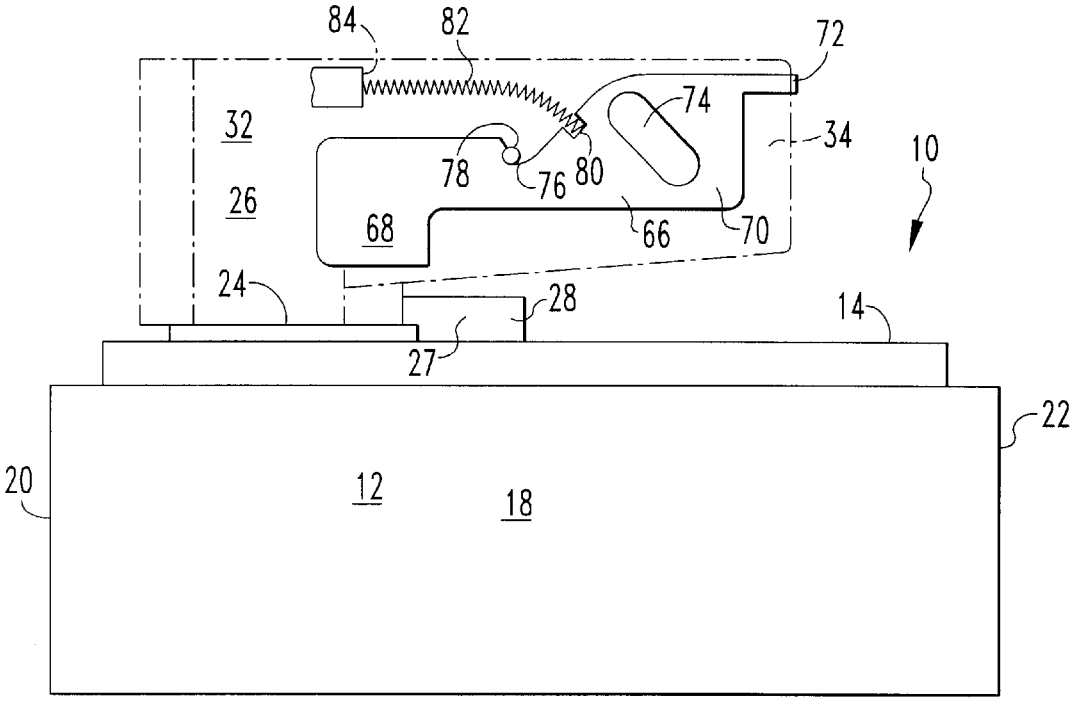
FIG. 7 PRIOR ART
FIG. 7 is a bottom view of a prior art rotary handle operator, illustrating the handle in the off position and the lock plate in the unlocked position.

Referring to FIG. 7, a prior art lock plate 66 is illustrated. The prior art lock plate 66 includes a slot-engaging end 68 and a lock-engaging end 70, with the lock-engaging end 70 having a finger tab 72 and defining an aperture 74, dimensioned and configured to receive the shank of a lock. The lock plate 66 also includes a central pivot channel 76 for receiving the pivot 78, and a spring channel 80, for receiving a coil spring 82. The coil spring 82 is compressed between the spring channel 80 and the surface 84 within the handle 26. The coil spring 82 thereby biases the lock plate 66 towards its unlocked position, and permits rotation of the lock plate 66 around the pivot 78, when the finger tab 72 is raised, permitting insertion of a lock through the aperture 74. Use of the prior art lock plate 66 requires the use of a separate coil spring 82, thereby increasing both the number of components required for the locking mechanism, and the number of assembly steps required in assembling the locking mechanism.

Figure 8:
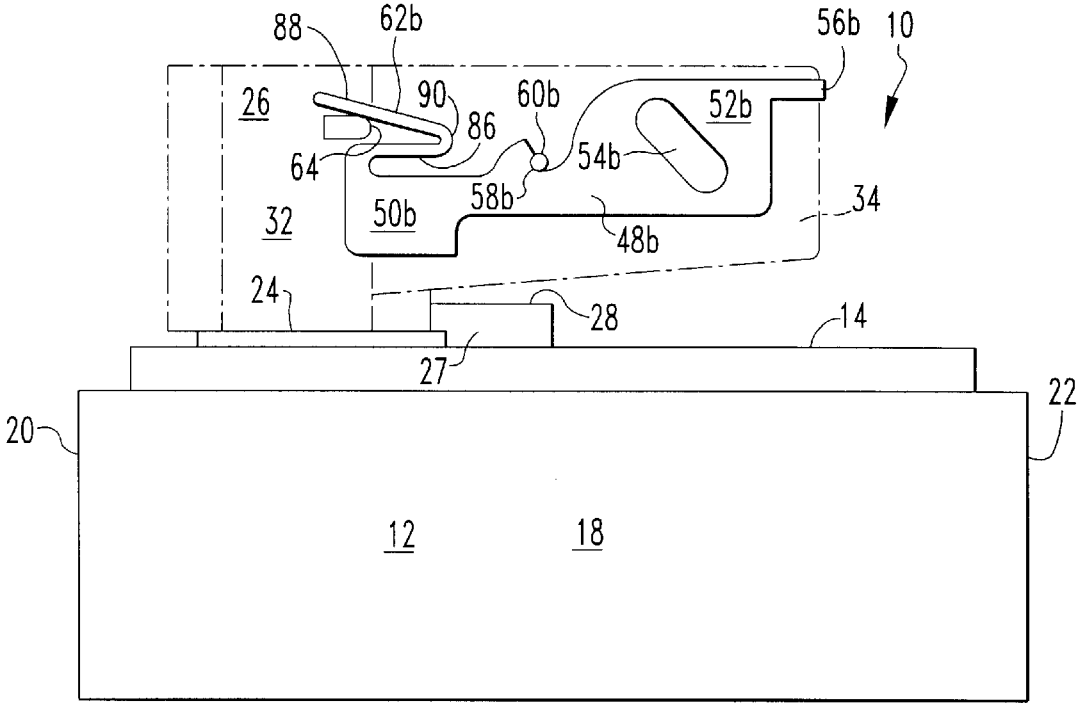
FIG. 8 is a bottom view of an alternative rotary handle operator of the present invention, illustrating the handle in the off position and the lock plate in the unlocked position.

Referring to FIG. 8, an alternative embodiment of the lock plate 48*b* is illustrated. The lock plate 48*b* includes an abutment-engaging end 50*b*, and a lock-engaging end 52*b*. The lock-engaging end 52*b* includes a lock aperture 54*b*, and a finger tab 56*b*. The lock plate 48*b* has a central portion including a channel 58*b*, fork receiving a pivot 60*b*. The channel 58*b* may be an open channel or a closed hole, as D long as a pivot is capable of passing through it. The lock-engaging end 52*b* includes a live spring 62*b*, having first and second elongated portions 86, 88 with an acute bend 90 therebetween. The elongated portions 86, 88 may be either linear or curved. Although the illustrated example spring 62*b* includes two elongated portions 86, 88 separated by a single acute bend 90, a number of elongated portions and acute bends therebetween may be increased as desired. By increasing the area over which stress is distributed through the use of multiple elongated portions connected by acute bends, the live spring 62*b* reduces the stress in each individual portion of its length.

In use, the lock plate 48*a*, 48*b* will be in the handle 26, biased towards it unlocked position of FIGS. 4 and 8 by the spring 62*a*, 62*b*. The housing 12 will be mounted to a circuit breaker 94, and the handle 26 will be rotated between its on and off positions to control the opening and closing of the circuit breaker 94. When it is desired to service the equipment protected by the circuit breaker 94, the handle 26 will be rotated towards its closed position of FIG. 3, lock plate 48*a*, 48*b* will be raised using its finger tab 56*a*, 56*b*, and a lock will be inserted into the aperture 54*a*, 54*b*, thereby securing the lock plate 48*a*, 48*b* in its locked position. The abutment-engaging end 50*a*, 50*b* abut the abutment 27, possibly by being located within the slot 28, thereby resisting movement of the handle 26 until the lock is removed, permitting the spring 62*a*, 62*b* to push the lock plate 48*a*, 48*b* towards its unlocked position.

While a specific embodiment of the invention has been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed is:

1. A rotary handle operator for a circuit breaker having an operating lever, said rotary handle operator comprising:

a housing defining a face, said face defining an abutment surface;

a handle pivotally secured to said face, said handle being structured for operative connection to an operating lever of a circuit breaker, said handle pivoting between an open position corresponding to the open position of the circuit breaker's operating lever, and a closed position corresponding to the closed position of the circuit breaker's operating lever;

a lock plate pivotally secured within said handle, said lock plate having a lock-engaging end defining an aperture dimensioned and configured to receive a shank of a lock, and an abutment surface-engaging end, said lock plate pivoting between a locked position wherein said abutment surface-engaging end engages said abutment surface and said aperture within said lock-engaging end protrudes from said handle, and an unlocked position wherein said lock plate is disengaged from said abutment surface; when said handle is in said open position, said lock plate further having a live spring, made as one piece with said lock plate, said spring being dimensioned and configured to bias said lock plate towards said unlocked position.

2. The rotary handle operator according to claim 1, wherein said abutment surface is formed by a slot defined within said housing's face.

3. The rotary handle operator according to claim 1, wherein said live spring is substantially linear.

4. The rotary handle operator according to claim 1, wherein said live spring is curved.

5. The rotary handle operator according to claim 1, wherein said live spring includes a plurality of sections joined by bends.

6. The rotary handle operator according to claim 1, wherein said lock plate is made from a semi-rigid, flexible material.

7. The rotary handle operator according to claim 6, wherein said lock plate is made from a material selected from the group consisting of plastic, polymer, and molded resin.

* * * * *